United States Patent [19]

Dennis

[11] Patent Number: 4,789,191

[45] Date of Patent: Dec. 6, 1988

[54] CENTERING DEVICE FOR SECURING AND CENTERING A DOOR HANDLE

[75] Inventor: Derek Dennis, Helsinge, Denmark

[73] Assignee: Carl F. Petersen A/S & Co. Vaerktøj, Møbel - og Bygningsbeslag KS, Denmark

[21] Appl. No.: 921,112

[22] Filed: Oct. 21, 1986

[30] Foreign Application Priority Data

Oct. 25, 1985 [DK] Denmark ..... 4902/85

[51] Int. Cl.[4] ..... E05B 1/00

[52] U.S. Cl. ..... 292/347; 292/DIG. 53; 292/348; 292/357; 292/1

[58] Field of Search ..... 292/347, 348, 356, 357, 292/DIG. 53, DIG. 60, 350, 1, 336.3; 16/DIG. 34, DIG. 24, DIG. 39, DIG. 40, DIG. 41, 114 R

[56] References Cited

U.S. PATENT DOCUMENTS

| | | | |
|---|---|---|---|
| 794,779 | 7/1905 | Galey et al. | 292/357 |
| 876,845 | 1/1908 | Smart | 16/DIG. 34 |
| 1,724,630 | 8/1929 | Wilson | 292/357 |
| 2,027,608 | 1/1936 | Moller | 292/357 |
| 2,423,206 | 7/1947 | Schlage | 292/357 |
| 2,795,948 | 6/1957 | Rayburn | 292/357 |
| 2,797,949 | 7/1957 | Schweitzer | 292/336.3 |
| 3,107,113 | 10/1963 | Sconzo | 292/356 |
| 3,427,061 | 2/1969 | McMeen et al. | 292/357 |
| 3,955,387 | 5/1976 | Best et al. | 292/336.3 |
| 4,037,865 | 7/1977 | Hook | 292/357 |
| 4,067,599 | 1/1978 | Ohno | 292/357 |
| 4,236,396 | 12/1980 | Surko, Jr. et al. | 292/357 |
| 4,460,204 | 7/1984 | Olsen | 292/356 |
| 4,597,600 | 7/1986 | Wilke et al. | 292/336.3 |

FOREIGN PATENT DOCUMENTS

| | | | |
|---|---|---|---|
| 150020B | 11/1986 | Denmark . | |
| 1029703 | 5/1958 | Fed. Rep. of Germany | 292/356 |
| 2250566 | 4/1974 | Fed. Rep. of Germany | 292/357 |
| 2608292 | 9/1977 | Fed. Rep. of Germany . | |
| 3127151 | 1/1983 | Fed. Rep. of Germany | 292/348 |
| 3332768 | 3/1985 | Fed. Rep. of Germany | 292/50 |
| 93667 | 12/1938 | Sweden | 292/357 |
| 103974 | 3/1942 | Sweden | 292/357 |
| 130174 | 11/1950 | Sweden | 292/357 |
| 737495 | 9/1955 | United Kingdom | 292/336.3 |
| 827889 | 2/1960 | United Kingdom | 292/336.3 |
| 976118 | 11/1964 | United Kingdom . | |
| 1084823 | 9/1967 | United Kingdom . | |

*Primary Examiner*—Gary L. Smith
*Assistant Examiner*—Eric K. Nicholson
*Attorney, Agent, or Firm*—Finnegan, Henderson, Farabow, Garrett & Dunner

[57] ABSTRACT

A device for centering and securing a pair of door handles in a door having a hole of circular cross section and a mortise lock with a square door handle mandrel. The device consists of 2 sets of three plate-shaped bodies engaging one another, the outer one having a hole for the bearing of a door handle and being larger than the door hole, a central body having essentially the same diameter as the door hole, and an inner body smaller than the door hole, all having a central hole for passage of the mandrel. The inner body and the outer body are clamped together by screws which pass through recesses in the central body. Consequently, the inner and outer bodies can be shifted in relation to the central body to compensate for any lack of alignment between the mandrel and the door hole prior to tightening of the screws. Then the screws are tightened so that the outer body and the inner body are clamped together around the central body and then the 2 sets are clamped to each other.

3 Claims, 2 Drawing Sheets

CENTERING DEVICE FOR SECURING AND CENTERING A DOOR HANDLE

BACKGROUND OF THE INVENTION

The invention concerns a centering device for securing and centering a door handle in connection with the mounting of the door handle in a mortise lock fitted in a door, said door being provided—prior to the fitting of the mortise lock—with a door hole of circular cross-section to receive the door handles.

The Danish Patent No. 150020B discloses a method of securing and centering the bearing of a door handle by a guide means, and a guide means for use in the performance of the method.

The art described in that application, which is the most immediate prior art of the present invention, requires tools for tooling the door in the immediate vicinity of the door holes, and this tool must even be of a special type if the door handle is to be mounted rapidly and easily. Further, the art described in that application cannot be used in connection with steel doors, but only in connection with doors of wood.

The object of the invention is to provide a centering device of the type stated in the opening paragraph, which enables rapid and effective attachment and centering of a door handle in a door without the use of special tools for tooling the door.

SUMMARY OF THE INVENTION

This object is achieved according to the invention in that the centering device consists of three plate-shaped bodies engaging one another, the outermost one of which with respect to the door having a central hole for the door handle or its bearing and a greater outside diameter than the door hole, the inner body with respect to the door having a smaller outside diameter than the door hole when the door is a wooden door, said outer and inner bodies being adapted to be clamped against each other by clamping means, e.g. screws or bolts, to fix the central body, which has the same outside diameter as the door hole and recesses or openings in the edge for the passage of the clamping means and of any through-going mounting bolts, said central body and said inner body having a central opening for the passage of a door handle mandrel with great clearance.

The mounting takes place very simply by applying at each side of the door a centering device with its three bodies kept together unclamped by the clamping means. These two centering devices are placed in the respective door holes at their respective sides of the mortise lock, and the door handles and the door handle mandrel interconnecting these is fitted and tilted into place, and then any through-going mounting bolts are fitted, the three bodies of each centering device are clamped against each other, and the through-going mounting bolts are tightened.

When the door is a steel door, the inner body is elongate and has a greater length, but smaller width than the diameter of the door hole, and the central body has essentially the same thickness as the door leaf of the steel door.

To facilitate the mounting of the centering device in the steel door, a compression spring is provided on the inner side of the inner body.

BRIEF DESCRIPTION OF THE DRAWINGS

The invention will be described more fully below with reference to the drawing, in which.

DETAILED DESCRIPTION OF THE INVENTION

Figure 1:
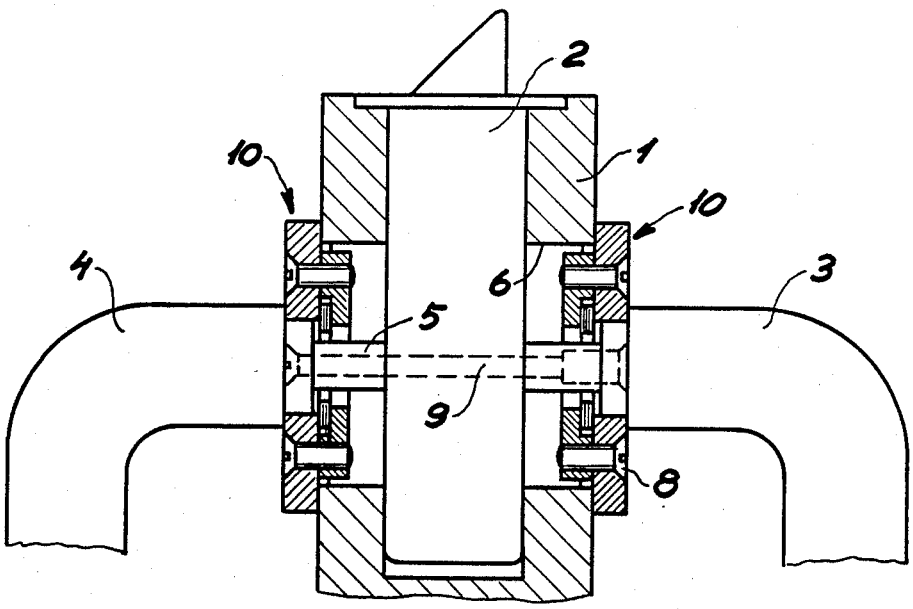
FIG. 1 is a horizontal section of part of a wooden door with a fitted mortise lock and with door handles fitted according to the invention in each of its centering devices.

FIG. 1 shows a wooden door 1 with fitted mortise lock 2 and two mounted door handles 3 and 4. The door handles are mounted in a known manner at their respective sides of door handle mandrel 5, which is square in cross-section and also extends through a mortise lock hole of square cross-section. The door handles 3 and 4 are secured in an axial direction on the door handle mandrel 5 by means of pointed screws (not shown).

The door handles 3 and 4 or their bearings are supported by their respective centering devices in directions perpendicular to the door handle mandrel 5, and the centering devices are in turn supported by the door hole 6 of circular cross-section bored through the wooden door 1.

The problem relating to the mounting of the door handles 3 and 4 is that the door hole 6 is not exactly concentric with the mortise lock hole for the door handle mandrel 5.

Figure 2:
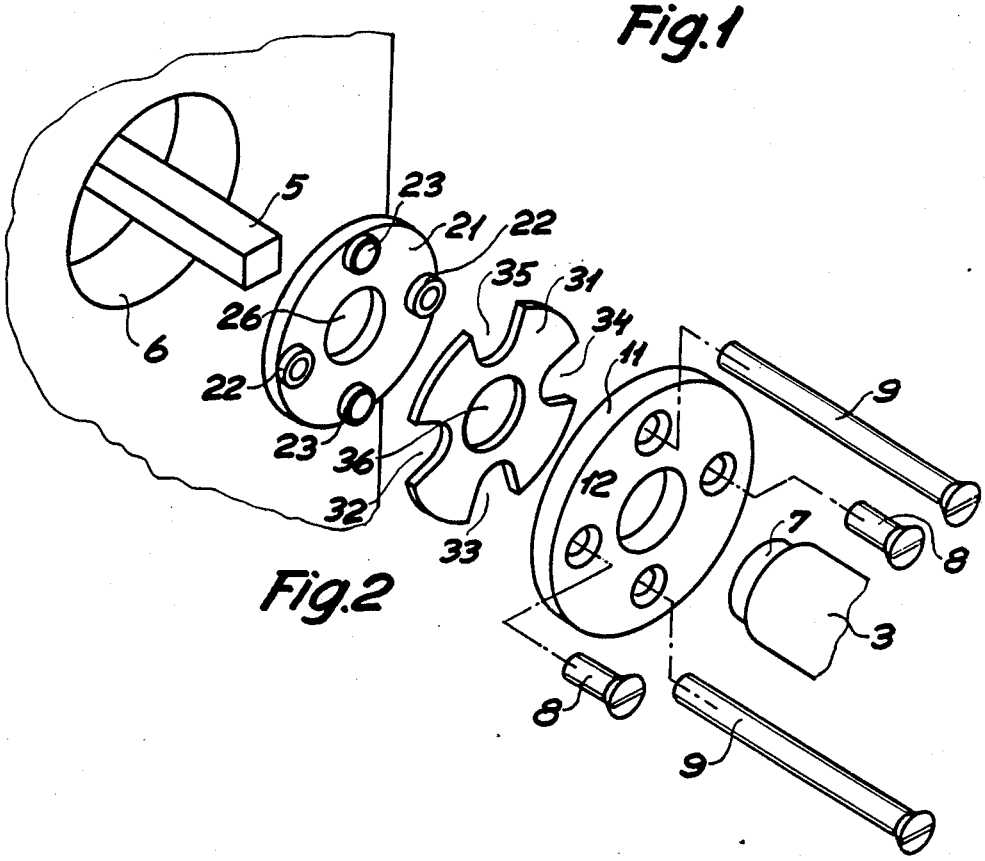
FIG. 2 is a perspective view of one side of the door of FIG. 1 with the centering device of that side and the end of the door handle pulled apart and away from the door hole and the door handle mandrel.

This problem of mounting is eliminated with the centering device 10, which is shown more clearly in FIG. 2.

The centering device 10 consists of an outer body 11 whose centre has a hole 12 for the bearing 7 of the door handle. This outer body 11 has a greater outside diameter than the door hole 6.

Further, the centering device 10 consists of an inner body 21 having a smaller outside diameter than the door hole 6 in the embodiment shown in FIGS. 1 and 2 for a wooden door 1. This outer body 11 and the inner body 21 are adapted to be clamped against each other by means of screws 8 to fix the central body 31 of the centering device 10. The central body 31 has the same outside diameter as the door hole 6 and has recesses 32, 34 and 33, 35 in the edge for the passage of the screws and through-going mounting bolts 9, respectively, by means of which a centering device 10 at one side of the door 1 can be clamped against another centering device 10 at the other side of the door 1. It should be noted that also the mortise lock 2 has openings (not shown) for the passage of the mounting bolts 9.

Both the central body 31 and the inner body 21 have central openings 36 and 26 permitting passage of the door handle mandrel 5 with great clearance.

Finally, it should be noted that the inner body 21 of the centering device 10 has internally threaded projections 22 for the screws 8 and projections 23 with holes for the mounting bolts 9.

When performing the mounting operation, all the parts are screwed together by means of the screw 8 and the mounting bolts 9, and the door handles 3 and 4 are positioned on the door handle mandrel 5, but without tightening of the screws 8 and the mounting bolts 9. Accordingly, the central body 31 of the centering devices 10 is freely slidable somewhat in directions perpendicular to the door handle mandrel 5, so that its central opening 36 is not necessarily co-axial with the central openings 12 and 26 in the outer body 11 and the inner body 21, respectively. The extent to which the central body 31 is slidable is of course determined by the size of its recesses 32-35 and of its central opening 36, but a few mm to each side will usually suffice for neutralizing the eccentricity of the door handle mandrel 5 or the hole in the mortise lock 2 with respect to the door hole 6.

When the parts are placed as shown in FIG. 1, the mounting bolts 9 and the screws 8 are tightened in said order, and the door handles 3 and 4 are finally secured to the door handle mandrel by tightening the pointed screws.

Figure 3:
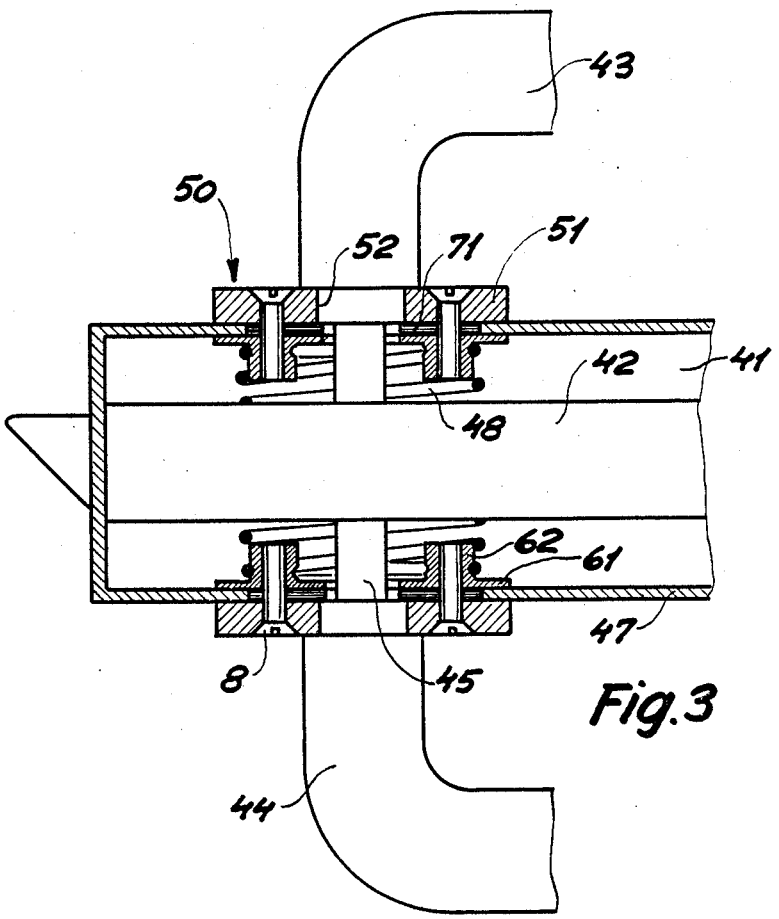
FIG. 3 is a horizontal section of part of a steel door with a fitted mortise lock and with door handles fitted according to the invention in each of its centering devices.

FIG. 3 shows, in a manner similar to FIG. 1, a steel door 41 with fitted mortise lock 42 and two mounted door handles 43 and 44 secured at their respective ends of a door handle mandrel 45 of square cross-section.

Like in FIG. 1, the door handles 43 and 44 or their bearings are supported by their respective centering devices 50 of a slightly different embodiment with respect to the centering device 10 of FIGS. 1 and 2.

However, also in the embodiment shown in FIG. 3, the centering device 50 consists of an outer body 51 and an inner body 61, which are adapted to be clamped together by means of screws 8 to fix the central body 71 of the centering device 50, said central body having in this embodiment the same thickness as the door leaf 47 of the steel door 41.

Figure 4:
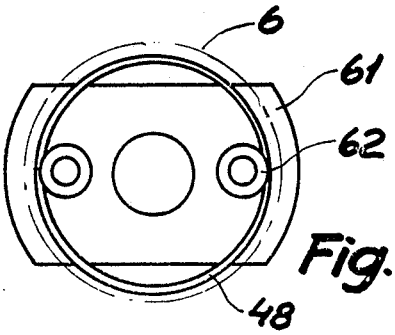
FIG. 4 shows the inner body in one of the centering devices shown in FIG. 3 with the compression spring secured thereto.

In the steel door embodiment of FIG. 3, there are no through-going mounting bolts, even though such may be used, if desired. Further, the inner body 61 of the centering device 50 has the elongate shape shown in FIG. 4, so that only in its width is it smaller than the door hole 6 shown in broken lines.

The projection 62 of the inner body 61, having threads for the screws 8, is disposed at the side facing the mortise lock 42 and forms a mounting for a compression spring 48.

In the mounting operation, the inner body with the compression spring 48 can be passed through the door hole 6 in the relatively thick door leaf 47 and be kept in place by the frictional engagement of the compression spring 48 with the mortise lock 42, while the outer body 51 and the central body 71 are placed in position and screwed on by the screws 8.

Like in the embodiment shown in FIGS. 1 and 2, the outer body 51 and the inner body 61 of each centering device can be moved together with respect to the central body 71 disposed in the door hole 6, until the central opening 52 in the outer body 51 is concentric with the mandrel hole in the mortise lock 42. Then the screws 8 are tightened so that the outer body 51 and the inner body 61 are clamped around the central body 71 and around the door leaf 47 of the steel door 41.

I claim:

1. A device for centering and securing a pair of door handles on a door having a hole therethrough of circular cross-section and an opening in one edge extending transverse to and communicating with said hole, said opening being adapted to receive a mortise lock having a door handle mandrel, said device comprising two sets of three plate-shaped bodies engaging one another with one set being mounted on each side of the door adjacent the door hole, each set comprising an outer plate having a central hole for receiving the door handle and permitting its connection to one end of the door handle mandrel, said outer plate having an outer dimension greater than the door hole, an inner plate having a diameter smaller than the diameter of the door hole and a central opening for passage of the mandrel, and a central plate having a diameter essentially the same as the door hole and located between said inner and outer plates, said central plate also having an opening for passage of the mandel, means for clamping the three plates of each set together to fix the central plate relative to the inner and outer plates and means for clamping the two sets of plates together to hold them to opposite sides of the door hole.

2. The device of claim 1, wherein the means for clamping the three plates of each set together comprises threaded screws that extend through holes in the outer plate and engage threaded bores in the inner plate, said central plate having openings therein permitting passage of said screws, said openings being larger than said screws to permit said inner and outer plates to be shifted relative to said central plate prior to said plates being clamped together in a set.

3. The device of claim 2, wherein the means for clamping the two sets of plates together comprises at least a pair of mounting bolts that extend through holes in the inner and outer plates of each set, said central plate having openings for said bolts that are larger than said bolts to permit said inner and outer plates to be shifted relative to the central plate prior to said plates being clamped together in a set.

* * * * *